US005382121A

United States Patent [19]

Bicknell

[11] Patent Number: 5,382,121

[45] Date of Patent: Jan. 17, 1995

[54] DRILL BIT FOR USE IN CONCRETE AND ASPHALT

[76] Inventor: David P. Bicknell, P.O. Box 627, Rockland, Me. 04841

[21] Appl. No.: 115,021

[22] Filed: Sep. 2, 1993

[51] Int. Cl.[6] ..... B23B 51/02

[52] U.S. Cl. ..... 408/57; 175/323; 175/395; 408/230

[58] Field of Search ..... 408/57, 56, 59, 60, 408/227, 230; 175/323, 324, 394, 395, 415

[56] References Cited

U.S. PATENT DOCUMENTS

| | | | |
|---|---|---|---|
| 2,733,943 | 2/1956 | Nater | 175/323 |
| 4,210,215 | 7/1980 | Peetz et al. | 175/323 |

FOREIGN PATENT DOCUMENTS

| | | | |
|---|---|---|---|
| 203828 | 6/1959 | Austria | 408/57 |
| 2756140 | 6/1979 | Germany | 175/323 |
| 2910323 | 10/1980 | Germany | 408/59 |
| 3004077 | 8/1981 | Germany | 175/395 |
| 1108373 | 4/1968 | United Kingdom | 175/323 |

OTHER PUBLICATIONS

Tool and Manufacturing Engineers Handbook, Fourth Edition, vol. 1, Machining, Society of Manufacturing Engineers, 1983, p. 9.14.

*Primary Examiner*—Daniel W. Howell
*Attorney, Agent, or Firm*—Frederick R. Cantor

[57] ABSTRACT

A drill bit for drilling holes in concrete and asphalt, or the like, includes a circular drill bit body having two helical grooves in its cylindrical side surface. Pressurized air is injected into the drilled hole through a passage system extending longitudinally within the drill bit. The injected air is forced out of the drilled hole through the helical grooves, such that particulates formed by the drilling process are flushed with the air out of the hole. The flushing action prevents the bit from becoming immobilized by heated asphalt sticking against the drill bit side surface.

4 Claims, 1 Drawing Sheet

DRILL BIT FOR USE IN CONCRETE AND ASPHALT

BACKGROUND OF THE PRESENT INVENTION

The present invention relates to drill bits.

The present invention more particularly relates to drill bits for drilling holes in concrete and asphalt.

Holes can be drilled in concrete and asphalt, using pneumatically powered drilling machines. Such drilling machines commonly include mechanisms for rotating the drill bit, and simultaneously vibrating the drill bit axially. The cutting action may be considered as a combined axial percussive fracturing of the concrete surface, and a rotary scraping of the surface for dislodging the concrete particles loosened by the fracturing process. The drilling machines may be handoperated portable machines, or machines supported on trailers or other wheeled vehicles.

The drill bits commonly are elongated steel shafts having hexagonal cross sections. The terminal end of the hexagonal shaft carries a hardened drilling insert, extending transversely thereacross; the cutting insert usually has a sharpened V-shaped cutting edge formed of tungsten carbide. As the drill bit rotates and vibrates axially, the sharpened V-shaped cutting edge delivers percussive blows to the concrete, thereby fracturing the concrete surface.

Concrete fragments produced by the drill bit are commonly removed from the drilled hole by feeding pressurized air downwardly through a passage system in the drill bit. The pressurized air is injected into the drilled hole in near proximity to the cutting edge of the drilling insert, whereby the pressurized air flushes the concrete debris upwardly, out of the drilled hole, and through the segmental spaces formed between the hole side surface and the flat side surfaces of the hexagonal bit. The pressurized air also serves the useful function of cooling the drilling insert, thereby somewhat prolonging the drill bit service life, before the insert has to be resharpened (or eventually discarded).

Pneumatically operated drilling machines usable in concrete are available from multiple sources, e.g. Chicago Pneumatic, Harper, Jet and Sullair. Usable drill bits are available from multiple sources, e.g. Bicknell Manufacturing Co., in Rockland, Me.

In recent years it has become necessary to drill holes in concrete roadways having an asphalt overlay, that defines the road surface. Such drilled holes are used by gas utility companies for installation of sniffer tubes in the concrete, for the purpose of monitoring, or testing, for gas leaks. It has been found that when conventional pneumatic drilling machines and drill bits are used to drill holes in concrete overlaid with asphalt, the drill bits tend to become "seized" in the asphalt. During the drilling operation, the smooth steel sides of the hexagonal drill bit become heated due to frictional contact with the asphalt, the concrete, and particulates generated by the drilling process. The asphalt partially melts and becomes sticky, causing at least a partial seal to form between the side surfaces of the drill and the asphalt. This partial seal causes a blockage of the air flow, and an ensuing build up of heat at the drilling insert. In some cases the drill bit will break off due to the heat build-up.

As a related matter, when the drill bit becomes "seized" by the warmed asphalt, the human operator of the drilling machine will often try to force the drill bit into, or out of, the drilled hole in an effort to complete the hole, or free the bit from its seized condition. In some cases the operators have experienced lower back pain and soft tissue damage, and some Workers Compensation claims have been filed as a result of such damage or injury.

SUMMARY OF THE PRESENT INVENTION

The present invention relates to drill bits.

The present invention, more particularly, relates to a drill bit that can be used for drilling holes in concrete and asphalt, e.g., concrete roadways overlaid with asphalt. As a principal feature of the present invention, the drill bit is formed to have two helical grooves or flutes extending along the length of the drill bit body to form two elongated helical lands. During a hole drilling operation in concrete overlaid with asphalt, pressurized air is conveyed downwardly through a passage in the drill bit body, into the bottom of the hole being drilled, so as to flush debris upwardly out of the hole through the helical grooves.

The helical grooves have circumferential cross sectional dimensions that are appreciably greater than the circumferential dimensions of the associated lands, such that the lands have relatively small surface areas presentable to the hole side surface. Such small surface areas lessen the potential for the asphalt to bridge the space between the hole surface and the drill bit side surface, so as to cause seizure of the drill bit.

The outer side surfaces of the lands on the drill bit are cylindrical, and essentially parallel to the hole side surface, such that the land surface is enabled to exert a shearing action on any debris, or asphalt, that may come in contact with the land surface. This feature somewhat lessens the possibility that asphalt might pack into the clearance between the cylindrical bit and the cylindrical hole, so as to immobilize the drill bit.

The helical lands on the drill bit have the same direction of twist as the bit rotational direction; preferably, the twist direction is counterclockwise, when viewed from the shank end of the drill bit. The direction of bit rotation and helical land twist, have been selected so that the land rotation tends to pump debris, i.e., particulates, out of the drilled hole. Thus, the debris is flushed out of the hole by the cooperative action of the pressurized air moving through the helical grooves, and the pumping action of the helical lands.

Drill bits constructed according to the invention have been found to be especially useful in drilling concrete overlaid with asphalt. The groove or flute design used on such bits prevents bit seizure in the asphalt, thereby overcoming a bit-seizure problem that existed with conventional rotary percussion drill bits having hexagonal cross sections.

In summary, and in accordance with the above discussion, the foregoing objectives are achieved in the following embodiment.

1. A drill bit adapted to rotate and vibrate axially, for drilling concrete and asphalt:
   - said drill bit comprising a drill body having a rotational axis and a cylindrical side surface concentric around said axis;
   - two helical grooves in said-drill body forming two helical lands extending around and along the drill body side surface;
   - said drill body having a terminal end adapted to penetrate the work to be drilled, and a hardened drilling insert extending transversely across said terminal end on a diametrical plane coincident with the drill body rotational axis;

said drilling insert having a diametrical dimension greater than the diameter of the drill body, so that the diameter of the drilled hole, is greater than the diameter of the drill body;

an air passage means extending longitudinally within the drill body, for supplying pressurized air to said terminal end of said drill body;

said air passage means comprising a flow duct communicating with a side surface of the drill body in near proximity to said drilling insert, whereby pressurized air is injected into the drilled hole alongside the drilling insert; and said helical grooves being in open communication with said flow duct, whereby the air injected into the drilled hole is enabled to convey debris through the helical grooves and out of the drilled hole.

2. The drill bit, as described in paragraph 1, wherein said flow duct extends at an acute angle to the drill body side surface, so that pressurized air is directed axially along the internal side surface of the drilled hole as the air emerges from the flow duct.

3. The drill bit, as described in paragraph 2, wherein said flow duct extends at an angle of about forty five (45) degrees to the drill body rotational axis.

4. The drill bit, as described in paragraph 2, wherein said flow duct is located in a plane that extends normal to the diametrical plane of the drilling insert.

5. The drill bit, as described in paragraph 1, wherein said air passage means, further comprises an elongated flow passage coincident with the rotational axis of the drill body; and said flow duct extending angularly from said flow passage, a relatively short distance from the drilling insert.

6. The drilling bit, as described in paragraph 5, wherein said elongated flow passage and said flow duct, are located in a plane that extends normal to the plane of the drilling insert.

7. The drill bit, as described in paragraph 1, wherein the circumferential cross-sectional dimension of each helical groove is appreciably greater than the circumferential cross sectional dimension of each helical land.

8. The drill bit, as described in paragraph 1, wherein each helical groove has a circumferential cross-sectional dimension that is at least approximately one hundred and twenty (120) degrees, measured from the drill body rotational axis.

9. The drill bit, as described in paragraph 1, wherein each helical groove has a radial depth dimension and circumferential width dimension; and the radial depth dimension of each groove being appreciably less than the circumferential width dimension.

10. The drill bit, as described in paragraph 9, wherein the circumferential width dimension of each groove is appreciably greater than the circumferential width dimension of each flute.

11. The drill bit, as described in paragraph 1, wherein the helical flutes are circumferentially directed in the same direction as the drill bit rotational direction.

12. The drill bit, as described in paragraph 1, wherein the helical flutes have a counter-clockwise twist, and the drill bit has a counter-clockwise rotational direction, when viewed in the drill bit feed direction.

13. The drill bit, as described in paragraph 1, wherein each helical groove has a cylindrical inner surface concentric with the drill bit rotational axis.

14. The drill bit, as described in paragraph 13, wherein each helical flute has a cylindrical outer surface concentric with the drill bit rotational axis.

15. The drill bit, as described in paragraph 14, wherein the area of the flute outer surface is appreciably less than the area of the groove inner surface.

BRIEF DESCRIPTION OF THE DRAWINGS OF THE PRESENT INVENTION

FIG. 1 is a side elevational view, of a drill bit, constructed according to the present invention.

FIG. 2, a fragmentary, enlarged, sectional view, of the terminal end of the drill bit, shown in FIG. 1.

FIG. 3 a sectional view, taken along line 3—3 in FIG. 2.

FIG. 4 s an enlarged, transverse, sectional view, taken along line 4—4 in FIG. 1.

DESCRIPTION OF THE PREFERRED EMBODIMENTS OF THE PRESENT INVENTION

Figure 1:
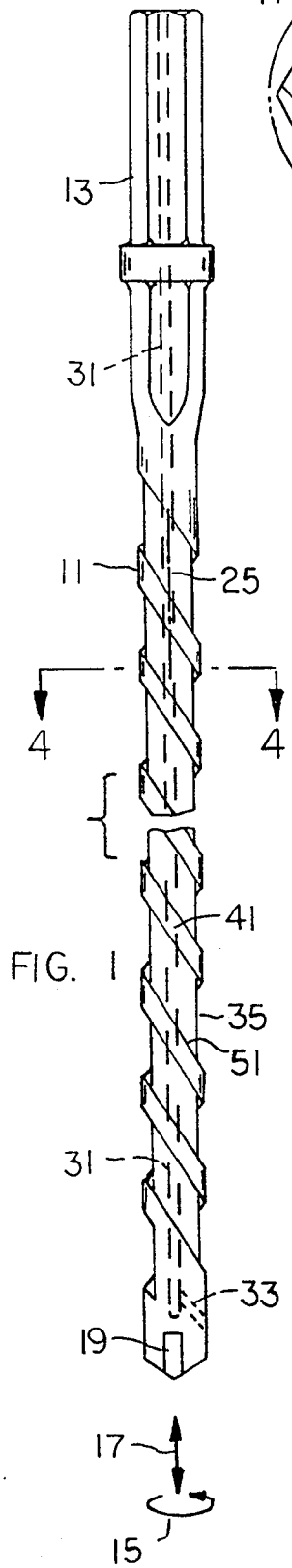

FIG. 1, is a side elevational view, of a drill bit, constructed according to the invention.

FIG. 1, shows a drill bit body 11, having a hexagonal shank portion 13, adapted to fit within the chuck portion of a conventional pneumatic drilling machine, not shown, whereby the drill bit is adapted to rotate, and also vibrate axially. Numeral 15, denotes the rotational drill bit motion, and numeral 17, denotes the vibrational motion. The lower end of the drill bit body 11, is adapted to penetrate a concrete work surface, for drilling a circular hole therein. Primary use of the drill bit 11, is in drilling concrete having a surface layer of asphalt, underlayered with soil, granite, or the like.

At its lower end, the drill bit 11, has a hardened drilling insert 19, preferably formed of tungsten carbide. The drill bit body is normally constructed of steel, or the like. Insert 19, comprises a flat-surfaced plate mounted within a transverse slot, formed in the end of the drill bit body 11. The drilling insert, i.e. plate, has a diametrical dimension 21, greater than the diametrical dimension 23, of the drill bit body, so that when the drill bit 11, is rotated around rotational axis 25, the drilled hole, will have a diameter greater than the diameter of the cylindrical drill bit body 11. Numeral 27, (FIG. 4), denotes the cylindrical surface of the drilled hole.

The drill bit 11, can have various different dimensions. Typically, drill bit 11, will have an axial length of about of about twenty-five (25) inches, and drilling insert 19, will have a diametrical dimension 21, measuring about 0.875 inch. The corresponding cylindrical drill bit body 11, will have a diameter of about 0.850 inch, whereby the radial clearance between the hole surface and the cylindrical side surface of the drill bit body measures about .013 inch.

Figure 2:
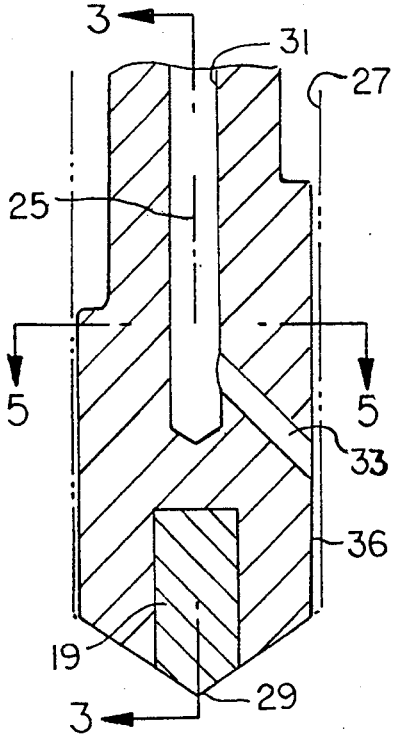

FIG. 2, is a fragmentary, enlarged, sectional view, of the terminal end of the drill bit shown in FIG. 1.

Figure 3:
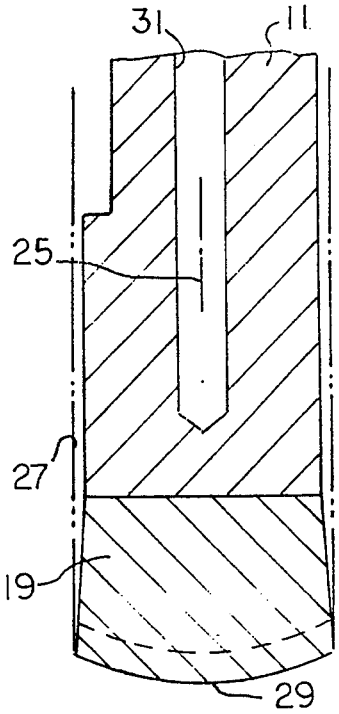

FIG. 3, is a sectional view, taken along line 3—3 in FIG. 2.

The cutting edge of drilling insert 19 has a V-shaped chisel configuration, as indicated at 29, in FIG. 2. In profile (FIG. 3), the cutting edge of the insert 19, is arcuate. The drilling insert 19, penetrates the concrete work surface, primarily as a result of the axial vibrational motion of the drill bit 11, denoted by numeral 17, in FIG. 1. Rotary motion of the drill bit 11, around central axis 25, dislodges particulates formed by the axial percussive action of cutting edge 29, on the concrete surface.

Figure 5:
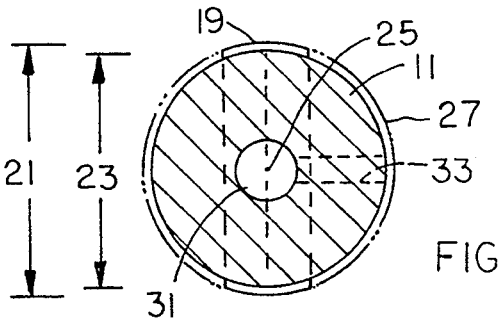
FIG. 5 is a sectional view, taken along line 5—5 in FIG. 2.

Loosened particulates are flushed out of the drilled hole by pressurized, i.e., compressed, air, introduced into the drill bit, via an axial passage 31, formed in the drill bit body 11. A flow duct 33, extends angularly downwardly from passage 31, at a point near the drilling insert 19, such that pressurized air is injected downwardly from the flow duct 33, into the drilled hole. The cylindrical side surface of the drill bit body, has a flat face 36, that angles slightly toward the drill bit axis, whereby a relief space is formed to receive the downflowing pressurized air, as the air emerges from flow duct 33. Flow Duct 33, can be angled to the central axis 25, at an angle of about forty-five (45) degrees. As best seen in FIG. 5, flow duct 33, is located in a plane that extends normal to the diametrical plane of drilling insert 19.

During a hole drilling operation, the drill bit 11, vibrates axially, so that cutting edge 29, moves toward and away from the concrete work surface, in cyclic fashion. As the cutting edge 29, moves upwardly away from the concrete surface, pressurized air passes underneath cutting edge 29, to flush debris, i.e., particulates, in a right-to-left direction, as viewed in FIG. 2. The particulates are thereby flushed upwardly, out of the hole, while the hole is being drilled. The flow of air transversely across cutting edge 29, is further advantageous, in that it cools the drilling insert 19, thereby prolonging its service life.

The debris-laden air flows upwardly, out of the drilled hole, via two helical grooves 35, formed in the side surface of the drill bit body. These helical grooves 35, extend from points near the drilling insert 19, to a point beyond the normal penetration length of the drill bit, such that airflow through grooves 35, will convey the debris out of the hole, throughout the entire drilling process.

Figure 4:
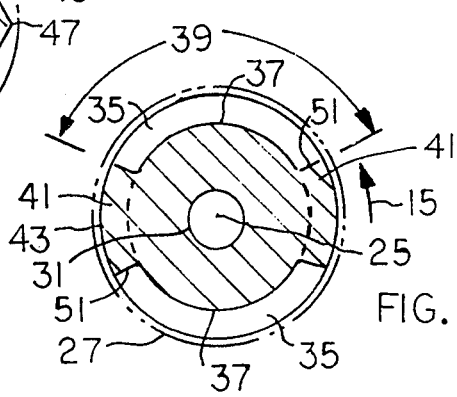

FIG. 4, is an enlarged, transverse, sectional view, taken along line 4—4 in FIG. 1.

As shown in FIG. 4, each helical groove 35, has a cross-section, such that its inner surface 37, is circular and concentric, around the central axis 25. The groove 35, cross-sectional circumferential dimension 39, measures approximately one hundred and twenty five (125) degrees, and a circumferential dimension of at least one hundred twenty (120) degrees, is preferred. The radial depth dimension of each groove 35, is considerably smaller than the circumferential dimension. Typically, the groove radial depth dimension is about 0.10 inch.

Helical Grooves 35, form two helical lands, denoted by numerals 41. Each land 41, has a cylindrical outer surface 43, concentric around the central axis 25. The radial clearance between flute surface 43, and the hole surface 27, may be about 0.013 inch, assuming a smooth hole surface.

Figure 6:
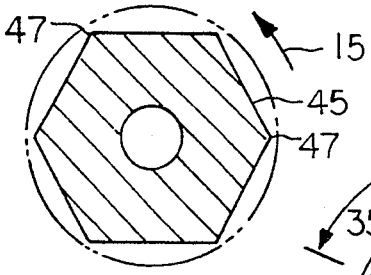
FIG. 6 PRIOR ART
FIG. 6, is a view, taken in the same direction as FIG. 4, but showing a prior art drill bit.

FIG. 6, is a view, taken in the same direction as FIG. 4, but showing a prior art drill bit.

In FIG. 6, the prior art drill has a hexagonal cross-section, defined by six flat side surfaces 45, and six corners 47. Surfaces 45, extend parallel to the central axis 25, i.e., the surfaces 45, are not helical or twisted. The drilling insert and air passage system in the FIG. 6 drill bit, are generally similar to the corresponding structures depicted in FIG. 2, except that the clearances are somewhat different at the bottom of the drilled hole, due to the hexagonal cross-sectional shape of the drill bit body.

It has been found that when the FIG. 6 drill bit was used for drilling holes in concrete, having a surface layer of asphalt, there was a tendency for the drill bit to become stuck, or "seized", in the asphalt, before the hole could be completed. The sticking problem is occasioned by the fact that the asphalt melts, due to the frictional heat generated by the drilling process.

In the use of the prior art device, the heat-generated melting action, is believed to be due, at least in part, to frictional contact between heated airborne particulates, and the asphalt hole surface. The heated particulates move axially, upwardly, along the flat surfaces 45, while the drill bit is rotating, as denoted by arrow 15 in FIG. 6. The rotational motion of the drill bit, tends to deflect the heated particulates laterally, i.e., rotationally, into the narrow spaces between corners 47 and the hole surface. Particulates tend to pack around the corners 47, and form bridges between the hole surface, and the drill bit. Heat transferred into the asphalt, melts some of the asphalt, so that particulates become embedded in the asphalt instead of being conveyed out of the hole. The asphalt-particulate bridges immobilize the drill bit.

With the helical groove construction, of the present invention, as depicted in FIG. 4, the heated particulates are entrained in the air flowing within the helical grooves 35. Each helical groove 35, has a cross-section, that is appreciably greater than that of the clearance space between land surface 43, and the hole side surface. Therefore, the pressurized air will be carried primarily in grooves 35, and not in the narrow clearance spaces. The air flowing along grooves 35, will then carry the heated particulates out of the drilled hole.

In preferred practice of the present invention, the direction of the twist of lands 41, is the same as the direction of rotation of the drill bit body around central axis 25. Thus, as viewed in the direction of FIG. 4, the lands 41, will be twisted in a counter-clockwise direction. The drill bit body will also rotate in the counter-clockwise direction, as denoted by arrow 15.

By having the drill bit rotate in the same direction as the direction of twist in the lands 41, the debris-flushing action is somewhat improved, in that the land edge surfaces 51, as seen in FIG. 4, tend to exert an upward pumping action on any contacted particulates. Particulates are conveyed out of the hole by the air entrainment action, and also by the pumping action of land edge surfaces 51. Edge surfaces 51, also act as helical cam surfaces.

The cross-sectional configuration of helical grooves 35, is selected to achieve a reasonably high air flow velocity, and hence a reasonably good entrainment action on the heated particulates. Surface 37, of the helical groove 35, is concentric with the central axis 25, so as to give the helical groove a reasonably small radial depth dimension (e.g. about 0.10 inch). This reduces the groove cross-section, and thus raises the linear air flow rate, for a given volumetric flow rate. At the same time, groove surface 37, is generally parallel to the hole side surface, so there is minimal tendency for the particulates to be thrown, or deflected, against the hole side surface.

The helix angle of the helical grooves, is preferably relatively small, in order to minimize centrifugal forces that would tend to throw particulates against the hole side surface. As shown in FIG. 1, the helix angle is about sixty (60) degrees relative to a radial plane, and about thirty degrees relative to the drill rotational axis. The helix angle is sufficient to minimize, or prevent, the packing action associated with the prior art drill of FIG. 6, without generating excessive centrifugal forces on the flowing particulates.

The large circumferential cross-sectional dimension 39, of each helical groove 35, is designed to reduce the land outer surface 43, in near proximity to the hole side surface, thereby reducing possible bridging action at surface 43. At the same time, each helical groove 35, has sufficient area for accommodating particulates in a clog free manner. Comparing the constructions of FIGS. 4 and 6, the FIG. 4 structure, provides two relatively large size passages, i.e., grooves 35, whereas the FIG. 6 construction, provides six relatively small segmental passages. The FIG. 4 construction, has a lessened tendency to become packed, or clogged, with particulates. A related factor is that in the FIG. 4 construction, the particulate-laden air moves in a helical pattern with the rotating drill bit, so that particulate migration into close clearance cracks is less of a problem. With the FIG. 6 arrangement, the rotation of the drill bit tends to throw particulates laterally into the close clearance areas at the corners 47, thereby promoting a sticking-clogging condition.

The drill bit construction of FIGS. 1 through 5, has been found to successfully overcome an asphalt clogging problem, associated with the prior art drill bit of FIG. 6.

The present invention, described above, relates to drill bits for use in concrete and asphalt, underlayered with soil, granite, or the like. Features of the present invention are recited in the appended claims. The drawings contained herein necessarily depict specific structural features and embodiments of the drills for use in concrete and asphalt, useful in the practice of the present invention.

However, it will be appreciated by those skilled in the arts pertaining thereto, that the present invention can be practiced in various alternate forms and configurations. Further, the previous detailed description of the preferred embodiments of the present invention, is presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A drill bit adapted to rotate and vibrate axially, for drilling concrete and asphalt:

said drill bit comprising a drill body having a rotational axis and a cylindrical side surface concentric around said axis;

two helical grooves in said drill body forming two helical lands extending around and along the drill body side surface;

said drill body having a terminal end adapted to penetrate the work to be drilled, and a hardened drilling insert extending transversely across said terminal end on a diametrical plane coincident with the drill body rotational axis;

said drilling insert having a diametrical dimension greater than the diameter of the drill body, so that the diameter of the drilled hole is greater than the diameter of the drill body;

an air intake passage means extending longitudinally within the drill body for supplying pressurized air to said terminal end of the drill body;

said air passage means comprising a flow duct communicating with a side surface of the drill body in near proximity to said drilling insert, whereby pressurized air is injected into the drilled hole alongside the drilling insert, said cylindrical surface having a flat face extending from said terminal end at a slight angle to the drill bit rotational axis to form a relief space, said flow duct having an exit end at said flat face, whereby pressurized air is delivered into the relief space; and said helical grooves being in open communication with said flow duct, whereby the air injected into the drilled hole is enabled to convey debris through the helical grooves and out of the drilled hole.

2. The drill bit of claim 1, wherein said flow duct extends at an acute angle to the drill body side surface so that pressurized air is directed axially along the internal side surface of the drilled hole as the air emerges from the flow duct.

3. The drill bit of claim 2, wherein said flow duct extends at an angle of about forty five (45) degrees to the drill body rotational axis.

4. The drill bit of claim 1, wherein the helix angle of said helical lands is approximately sixty degrees measured in relation to a radial plane normal to said drill bit rotational axis.

* * * * *